US006893515B2

(12) United States Patent
Guan et al.

(10) Patent No.: US 6,893,515 B2
(45) Date of Patent: May 17, 2005

(54) MANUFACTURING PROCESS FOR HIGHLY DUCTILE MAGNESIUM ALLOY

(75) Inventors: Jin-Chin Guan, Taipei Hsien (TW); Ming-Tarng Yeh, Taipei Hsien (TW); Jian-Yih Wang, Taipei Hsien (TW)

(73) Assignee: Hsu-Yang Technologies Co., Ltd., Taipei Hsien (TW)

( * ) Notice: Subject to any disclaimer, the term of this patent is extended or adjusted under 35 U.S.C. 154(b) by 206 days.

(21) Appl. No.: 10/241,650

(22) Filed: Sep. 12, 2002

(65) Prior Publication Data

US 2004/0040635 A1 Mar. 4, 2004

(51) Int. Cl.[7] ..... C22F 1/06
(52) U.S. Cl. ..... 148/557; 148/666; 148/667
(58) Field of Search ..... 148/557, 666, 148/667, 406, 420

(56) References Cited

U.S. PATENT DOCUMENTS 4,173,469 A * 11/1979 Unsworth et al. ..... 148/406
5,531,806 A * 7/1996 Webster ..... 75/594

FOREIGN PATENT DOCUMENTS

DE 3922593 A * 1/1991 ..... B22D/17/28

* cited by examiner

*Primary Examiner*—George Wyszomerski
*Assistant Examiner*—Janelle Morillo
(74) *Attorney, Agent, or Firm*—Troxell Law Office PLLC

(57) ABSTRACT

The present invention is related to a manufacturing process for highly ductile magnesium alloy, which is processable under plasticization at ambient temperature. The process includes melting in vacuum melt furnace or inert gas protected furnace, teeming into ingot, extrusion or rolling into finished material. Such highly ductile magnesium alloy has extremely excellent plastic deformability at ambient temperature and improves completely the deficiency associated with traditional commercial magnesium alloy that lacks plastic deformability at ambient temperature. The material is suitable for the structural components in automobiles, 3C products, appliances and office automation products.

4 Claims, 3 Drawing Sheets

MANUFACTURING PROCESS FOR HIGHLY DUCTILE MAGNESIUM ALLOY

FIELD OF THE INVENTION

Magnesium alloy is the lightest metal for structural material. It has high specific strength, high specific rigidity, good heat dissipation, EMI shielding and good recyclability. It is the best material of those meet environmental requirements and lightweight structural material requirements. However, the poor processability for magnesium alloy at ambient temperature is the most serious bottleneck to obstruct its application. The present invention is related to a manufacturing process for a highly ductile magnesium alloy. Basically, the process uses additional special alloy element to change the crystal morphology, so the plasticability at ambient temperature is improved.

BACKGROUND OF THE INVENTION

Recently, due to the trend of lightweight in automobiles, 3C products, appliances and office automation products, the applications of magnesium have attracted attention from every field. Nevertheless, due to poor processability at ambient temperature for traditional commercial magnesium alloy, the manufacturing of magnesium alloy structural components mostly relies on casting, a melting/solidification process. Especially, die casting or injection molding is dominant. Thus, the magnesium alloy product industry has been bothered by the low yield of thin wall products from die casting or injection molding process.

It has been reported and patented for production that addition of Y or Si could increase plasticability for magnesium alloy. But the processing temperature was as high as 200° C., so processability at ambient temperature is still insufficient. Besides, the process adopted a complicated melt-quench method, its operation is difficult and not popular.

Normal magnesium alloy has sufficient plasticability until it is heated up to above 200° C. The practical application of Wrought Materials by die casting at ambient temperature is limited due to low yield of finished products. In addition, magnesium and lithium are both so active that melting process is difficult. If the said patented melt-quench method is used, not only operation is difficult but also product shape is limited.

In view of the technical difficulty in the past, the present invention has the objective to maintain the low density characteristic for magnesium alloy in a process composed of melting in vacuum melt furnace or inert gas protected furnace, teeming into ingot, extrusion or rolling into highly ductile magnesium alloy material for further die casting for various functional components.

BRIEF DESCRIPTIONS OF THE DRAWINGS

DETAILED DESCRIPTION OF THE INVENTION

The following embodiments are used to describe the process.

<Embodiment> Alloy Melting in Vacuum Furnace and Atmosphere Furnace

Figure 2:
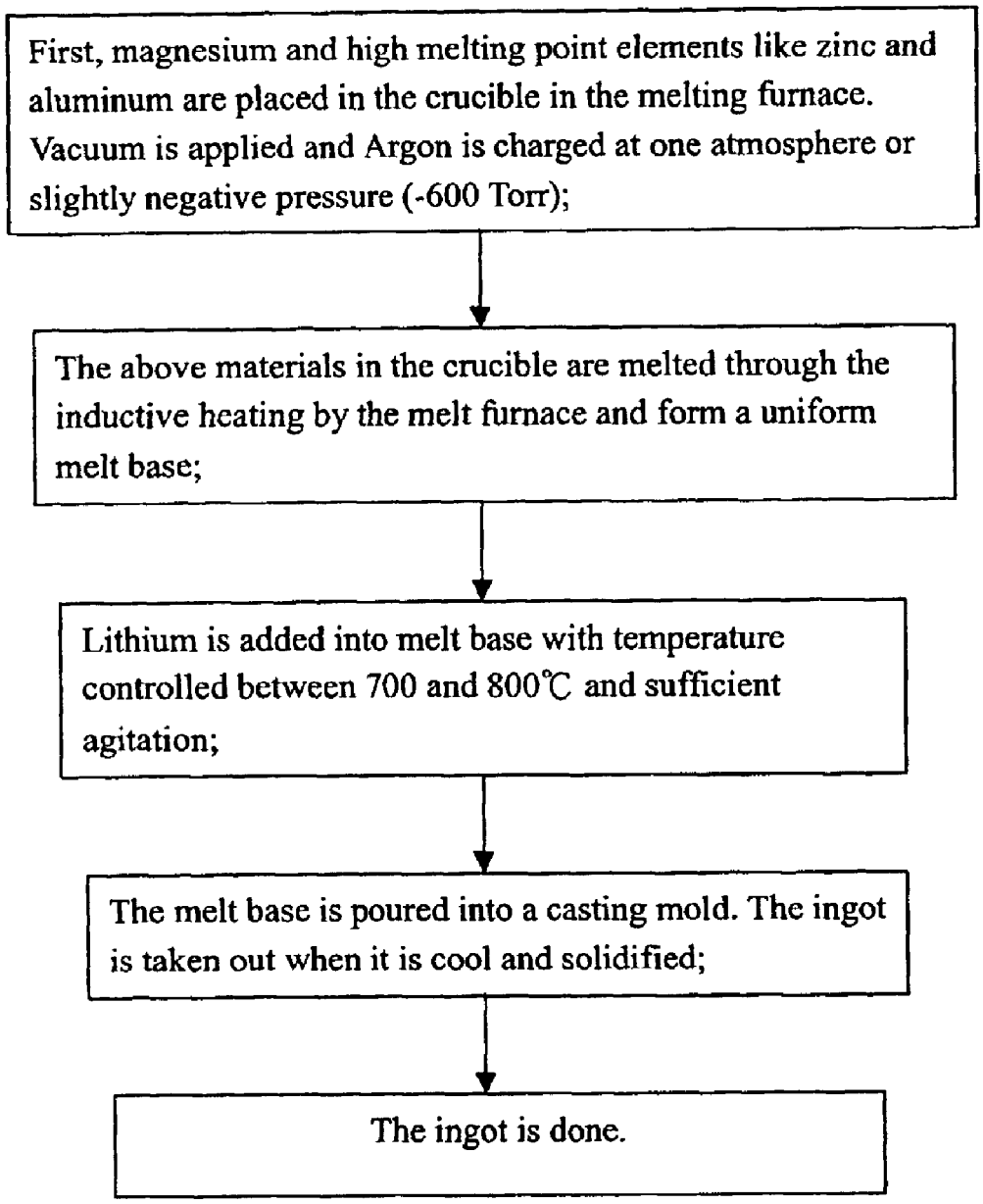
FIG. 2 is the process flow diagram for the highly ductile magnesium alloy in the present invention.

Magnesium has high affinity with oxygen, so its alloy has to be processed in vacuum furnace or non-oxygen atmosphere furnace. There is no exception for the manufacturing of highly ductile magnesium alloy. First, the vacuum melt furnace is set up. The function of control system is checked. Then, a special crucible is fixed into an inductive heating coil. At this moment, it is ready for the preparation of highly ductile magnesium alloy (please refer to FIG. 2) by the following procedures:

1. First, magnesium and high melting point elements like zinc and aluminum are placed in the crucible in the melting furnace. Vacuum is applied and Argon is charged at one atmosphere or slightly negative pressure (−600 Torr);
2. The above materials in the crucible are melted through the inductive heating by the melt furnace and form a uniform melt base;
3. Lithium is added into melt base with temperature controlled between 700 and 800° C. and sufficient agitation;
4. The melt base is poured into a casting mold. The ingot is taken out when it is cool and solidified.

<Embodiment> Design for Highly Ductile Magnesium Alloy

The reason for the poor ductility of current commercial magnesium alloy is its hexagonal lattice crystal structure and the formation of hard intermetallics. The design principle for highly ductile magnesium alloy is based on addition of special alloy element to change crystal morphology and avoid formation of intermetallics. As a result, the ductility and processability can be improved. To maintain the lightness of magnesium alloy as structural material characteristic, the addition of alloy element is focused on the use of low-density elements and alloy reinforcement.

After a systematic and careful study, it is found that Mg—Li alloy has characteristics in high strength, high ductility and low density, which perfectly meet the industrial requirements in lightness, thinness, shortness and smallness. An incredible market potential is discovered. When the lithium content is over 6% by weight, a clear body-centered cubic structure is formed. With increasing lithium content, body-centered cubic structure is increased. This means that alloy ductility is improved increasingly. However, overdose of additional element will be detrimental to alloy strength. The dosage is better controlled within 20%.

The following table shows the comparisons on compositions and mechanical properties between the four magnesium lithium alloys and the traditional commercial magnesium aluminum alloy (AZ31-O). Both the mechanical strength and elongation for AZ31 magnesium aluminum alloy at ambient temperature are poor. The elongation is merely 11%. The ingot from the four magnesium aluminum alloys in the present invention has dimension of 260×130×80 mm, weight of 4.1 kg and specific density of about 1.5. After tempering at 300° C. for one hour, the cast ingot is continuously rolled into sheets at 200° C. or at ambient temperature. When cold rolling reaches 30%, temporary inter-annealing at 200° C. is required for such sheets to have relatively excellent mechanical strength and elongation, especially elongation above 40%.

Further, the highly ductile magnesium alloy in the present invention can be made into sheets, rods and processable material through direct extrusion forming at 200~400° C.

Hence, the application is broadened.

| | Alloy composition (wt %) | | | Mechanical property at ambient temperature | |
|---|---|---|---|---|---|
| | Li | Zn | Al | Yield strength (MPa) | Elongation (%) |
| Mg—Al alloy | — | 1 | 3 | 105 | 11 |
| Mg—Al alloy 1 | 8.6 | 1.09 | — | 135 | 42 |
| Mg—Al alloy 2 | 9.3 | 1.10 | — | 160 | 40 |
| Mg—Al alloy 3 | 10.1 | 1.10 | — | 161 | 39 |
| Mg—Al alloy 4 | 15.6 | 1.07 | — | 101 | 45 |

<Embodiment> Deep Drawing

Deep Drawing is used to investigate the magnesium alloy in the present invention. The processability at ambient temperature is studied by a 100 Ton MTS tensile tester. The diagonal length for square punch is 45 mm. The clamp speed is 2.5 mm/s. Paraffin liquid is used for lubrication.

Limiting drawing ratio (LDR) is used to assess the processability. LDR is the ratio of the diagonal length of test sheet to the diagonal length of the square punch.

Figure 1:
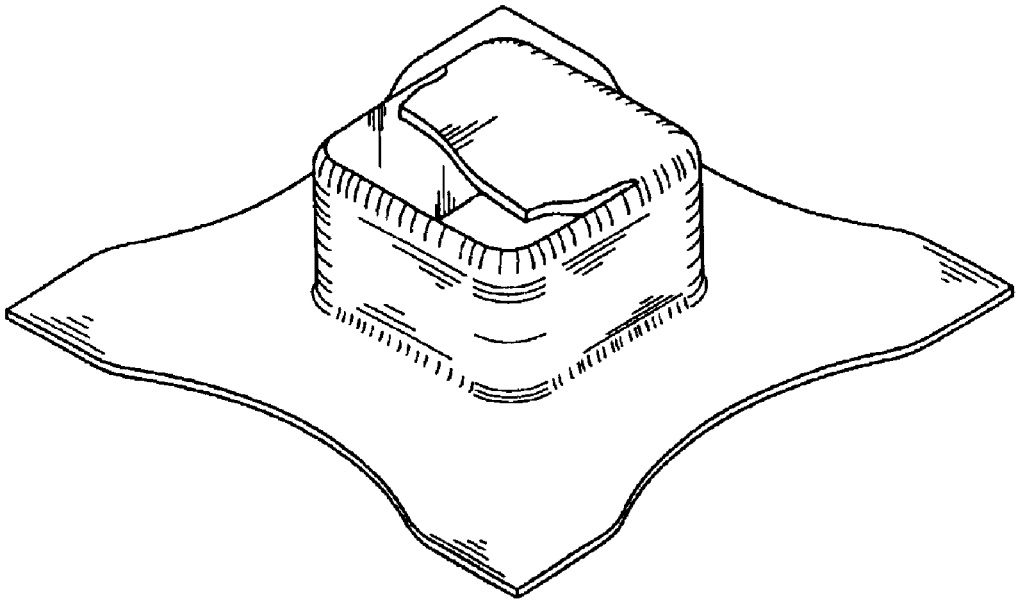
FIG. 1 Prior Art
FIG. 1 is an embodiment showing the deep drawing fracture for traditional commercial AZ31 magnesium alloy.
Figure 3:
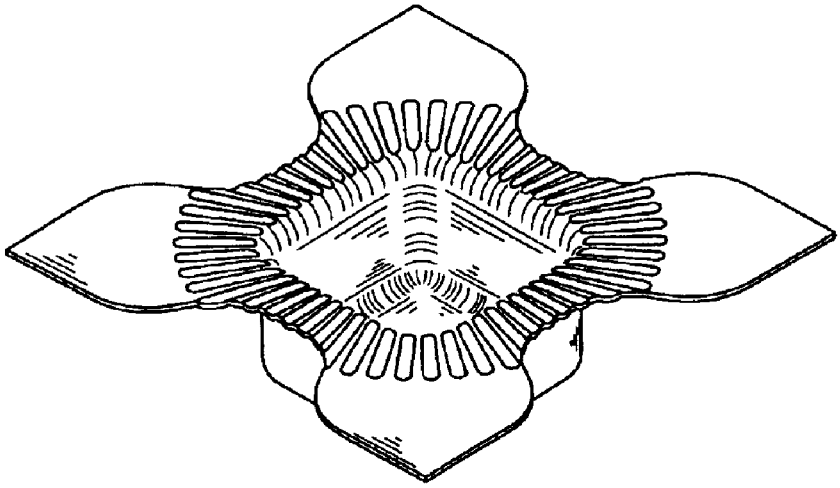
FIG. 3 is an embodiment showing successful deep drawing processing for the highly ductile magnesium alloy in the present invention.
Figure 4:
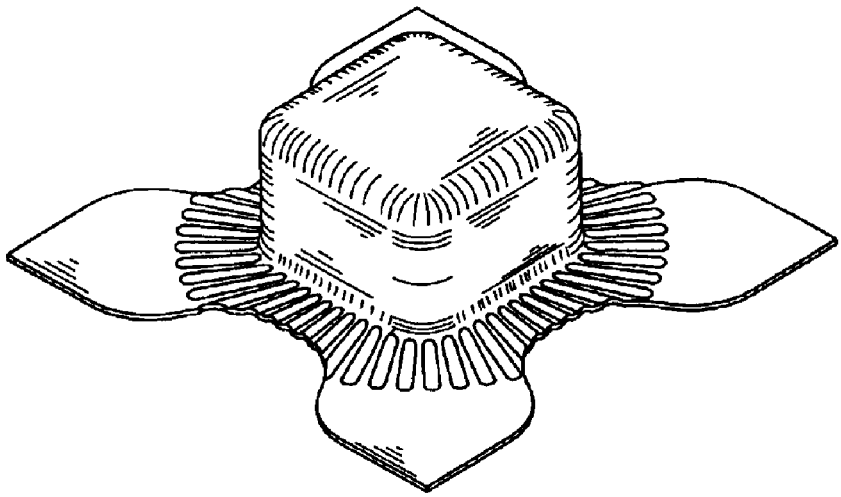
FIG. 4 is an embodiment showing at another viewing angle successful deep drawing processing for the highly ductile magnesium alloy in the present invention.

Traditional magnesium alloy AZ 31 is not processable by deep drawing at ambient temperature. The fracture is shown in FIG. 1. However, the highly ductile magnesium alloy in the present invention (sheet of 0.2 mm thickness) is processable at ambient temperature by deep drawing (as shown in FIG. 3 and FIG. 4) and the LDR value reaches up to 1.5.

What is claimed is:

1. A manufacturing method for a highly ductile magnesium alloy, which comprises the steps of:

a) melting magnesium and high melting point elements in a vacuum melting furnace having an argon atmosphere;

b) forming a first uniform melt base;

c) adding lithium to the first uniform melt base at temperatures between 700° C. and 800° C. to form a second uniform melt base;

d) pouring the second uniform melt base into a casting mold and cooling to form an ingot; and e) processing the ingot by performing steps selected from a group consisting of tempering, rolling, annealing, and extruding.

2. The method according to claim 1, wherein the processing step e) utilizes direct extrusion to process the ingot into sheets and rods at temperatures between 200° C. and 400° C.

3. The method according to claim 1, wherein the second uniform melt base formed in the adding step c) is 3 to 20 percent lithium by weight.

4. The method according to claim 1, wherein the highly ductile magnesium alloy is used for structural component in products selected from a group consisting of automobile products, 3C products, appliances, and office automation products.

* * * * *